United States Patent [19]

Bates, Jr. et al.

[11] Patent Number: 4,723,805

[45] Date of Patent: Feb. 9, 1988

[54] TRANSLOADER

[75] Inventors: H. John Bates, Jr., Yorba Linda; Gary L. Egbert, Diamond Bar, both of Calif.

[73] Assignee: NL Industries, Inc., New York, N.Y.

[21] Appl. No.: 915,519

[22] Filed: Oct. 6, 1986

[51] Int. Cl.[4] ..... B66C 1/40

[52] U.S. Cl. ..... 294/82.16; 175/5

[58] Field of Search ..... 294/82.16, 1.1, 82.11, 294/82.12, 82.24, 82.27, 89; 267/162; 175/5, 27; 254/270, 277, 337, 900

[56] References Cited

U.S. PATENT DOCUMENTS 3,804,183 4/1974 Duncan et al. ..... 254/277

4,498,698 2/1985 Zimmermann ..... 294/82.16

*Primary Examiner*—James B. Marbert

*Attorney, Agent, or Firm*—Browning, Bushman, Zamecki & Anderson

[57] ABSTRACT

A transloader provides means and method for adjusting multiple chains in an array for uniform tensioning. The transloader is mounted adjacent a reference member with chain adjustment rods passing through respective spring assemblies in a spring block. The central adjustment rod is adjusted to position the spring block with respect to the reference member and the remaining adjustment rods adjusted to position respective spring followers relative to the spring block thereby providing uniform tension on all chains.

12 Claims, 4 Drawing Figures

TRANSLOADER

BACKGROUND OF THE INVENTION

1. Field of the Invention

The present invention pertains to a method and apparatus for adjusting the tension in an array of chains, for example, in a drill string compensator, so as to provide uniform load distribution to all chains of the array.

2. Description of the Prior Art

There are many instances when arrays of chains are used to support and/or transmit loads. It is preferable to have the chains of the array share the load equally to thereby increase the safe operating margin and working life for the chains. However, the means and methods for tensioning chains used to date have been rather elementary and have not produced any real degree of uniformity in tensioning of the chains. For example, one method calls for striking the chains witha mallet and attempting to gauge tension by the timbre and resonance of the resulting sound. An equally ineffective method involves pushing against the chains by hand, much in the same manner as a motorist might do to check the various belts under the hood of his car. It will be readily appreciated that neither of these terminals would be likely to produce any degree of uniformity in tensioning nor would they be likely to work in noisy environments or with large, heavy chains.

An example of the use of chain arrays can be found in drill string compensators which are devices to compensate for the vertical motion imparted to marine vessels by normal wave action and are necessary when the vessel is supporting submerged equipment as, for example, during drilling or other undersea operations. Such vessels usually have a derrick fixed to the deck of the vessel with a crown block at the upper end of the derrick and a traveling block suspended from the crown block by a line arrayed between the sheaves of the blocks. The traveling block has a hook from which an elevator or the like is connected to depend into the water to the ocean floor. A fluid actuated system provides a reciprocal motion to allow the hook to be maintained at a fixed location relative to the undersea floor as the traveling block heaves with the wave action imparted to the vessel. Such compensators require the weight of the compensation apparatus to be supported by the same line by which the traveling block is suspended from the crown block which is fixed to the mast of the derrick.

Motion compensators are known for keeping either the crown block or the traveling block stationary relative to the undersea floor as the floating vessel moves. In either case, the respective block is supported by means of a pair of direct acting hydraulic or pneumatic piston and cylinder assemblies with multiple chain arrays providing the actual interconnect between the main frame and movable frame of the compensator device. Heretofore, the chains have been adjusted for tension by tightening a nut and bolt arrangement at one end of each chain with the relative tension between the chains being determined by either of the two methods discussed above, namely pushing on the chains or by hitting the chains with a mallet and attempting to ascertain like tones between the various chains of the array.

It will be readily appreciated by those skilled in the art that in a drill string compensating system the size and weight of the chains and their associated assemblies are such that manually pushing against the chains would hardly yield any adequate information as to the tension in each chain or comparison of tension between two chains. It is also clear to those skilled in the art that the background noise on a floating drill rig would be such that it would be substantially impossible to ascertain close or like tones, even assuming that the roughneck had sufficient musical talent to ascertain and compare such tones.

SUMMARY OF THE INVENTION

The subject transloader provides a means and method for adjusting the tension on chains connected in an array, for example extending around sheaves and between relatively movable and fixed members of a drill string compensator or the like. The chains are secured in the present invention with one end of each chain in an array fixedly attached to a first block and fed around respective sheaves. The other end of each chain is connected to a chain anchor rod passing through a second block. A spring assembly and a retainer plate are positioned between the second block and adjusting nuts on the respective chain anchor rods. A plurality of springs, such as a stack of belleville springs, are mounted in the spring assembly to provide individual tension to the respective chains. Adjustment is made by tightening the centermost chain anchor rod to a known measurable tension and the outer chains are adjusted to match this measurement.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 1:
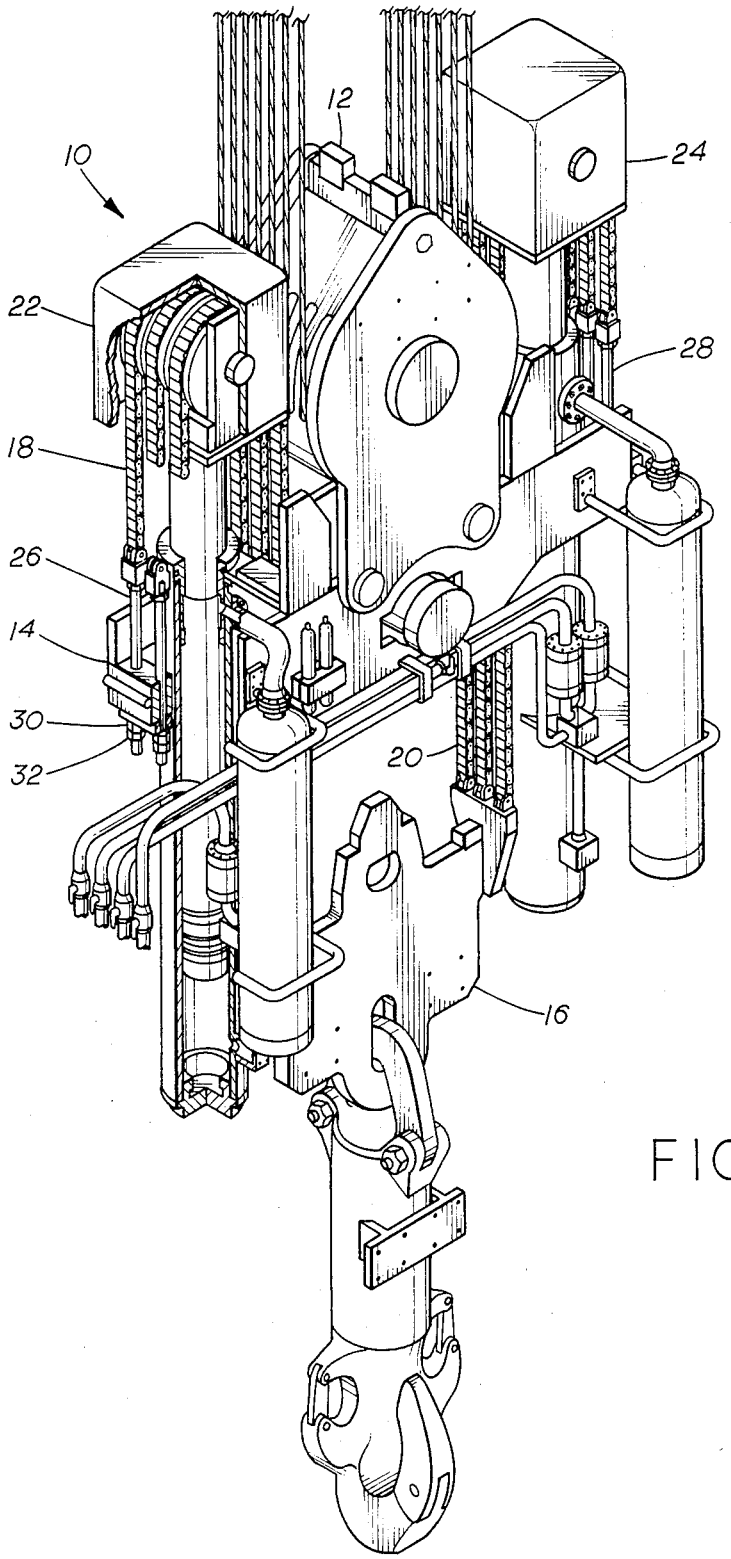
FIG. 1 is a perspective view of a typical drill string compensation device which would benefit from the present invention.

An embodiment of the present invention has been shown in connection with a drill string compensating system which would be used in an offshore well drilling system of known configuration (not shown). Such a well drilling system employs a derrick or mast which is mounted on a semisubmersible or floating platform in a body of water. A crown block is fixed at the top of the mast and has a traveling block suspended therefrom by a conventional array of lines extending about sheaves on the respective blocks and connected to a drawworks. Typically, a drill string compensation means, such as the one shown in FIG. 1, is carried on or made a portion of the movable block with the drill string itself being suspended from the drill string compensator. All of this is state of the art and is deemed to be sufficiently well known that it has not been illustrated.

FIG. 1 illustrates a representative drill string compensating system 10 which could be utilized in the above arrangement and which would profit from incorporation of the present invention. Details of structure and operation of this system can be found, for example, in U.S. Pat. No. 3,804,183, the disclosure of which is incorporated herein by reference. Only those portions necessary for the understanding of the present invention will be discussed.

The compensator 10 illustrated in FIG. 1 is suspended from a movable block 12 and includes a main frame 14 and a hook frame 16 connected at each end to the main frame by a plurality of chains 18 and 20. One end of each chain 18, 20 is fixedly connected to the hook frame 16 and the other end thereof passes around a respective chain sheave assembly 22, 24 and is secured to the main frame 14 by a chain length adjustment rod 26, 28 passing through respective apertures in the main frame 14 and held securely thereagainst by adjustment nuts 30 and jam nuts 32. It is clear that since the chains 18, 20 are individually adjusted by their respective chain length adjustment rods 26, 28, that it is substantially impossible to insure that each chain will have the same amount of tension. It is also quite clear that some additional means must be provided to assure the uniform tensioning in order to get better operating margins and increased chain life. While this possibly could be accomplished through the use of various and sundry gauges and the like, such a solution clearly would not be proper in this environment where rough handling and exposure to the elements are to be expected.

Figure 2:
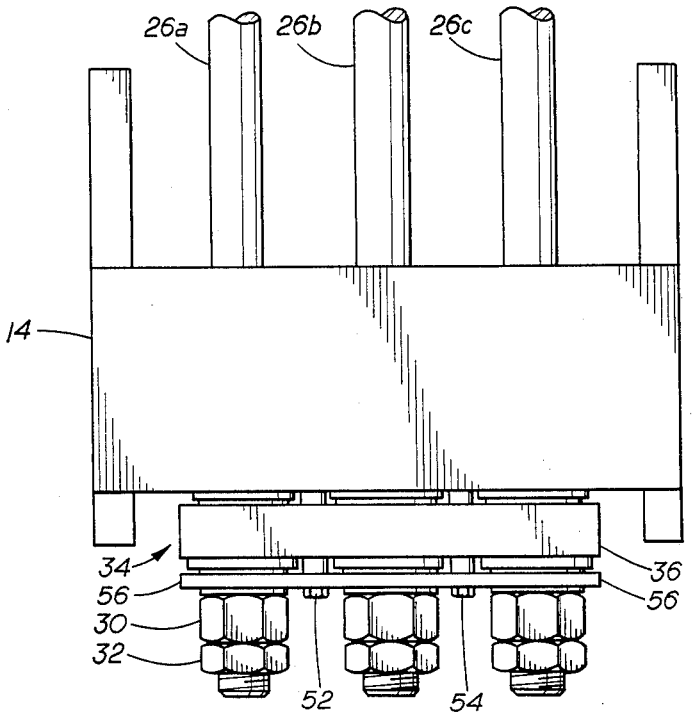
FIG. 2 is a side elevation of the transloader according to the present invention.
Figure 3:
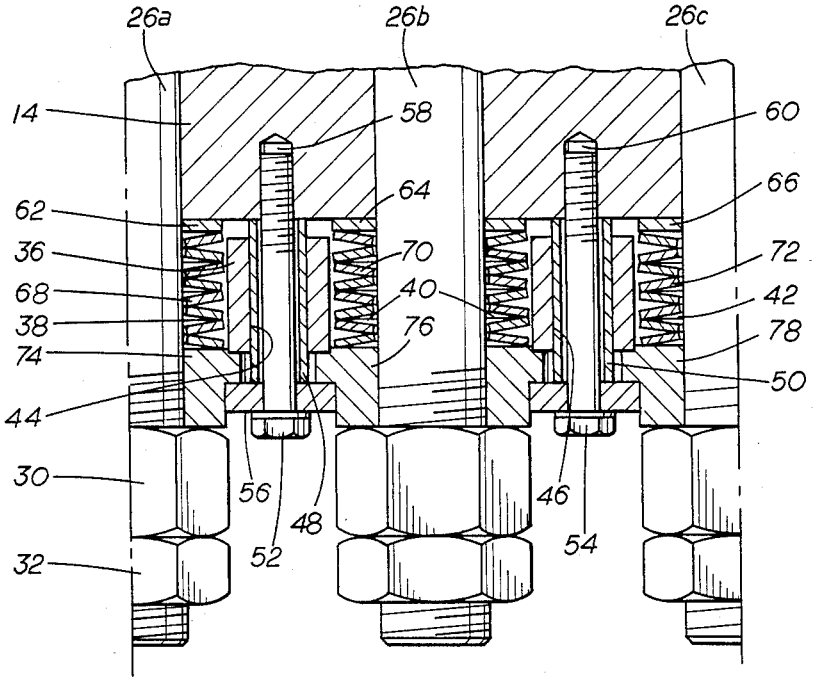
FIG. 3 is a transverse section through the transloader of FIG. 2 in an unloaded condition.
Figure 4:
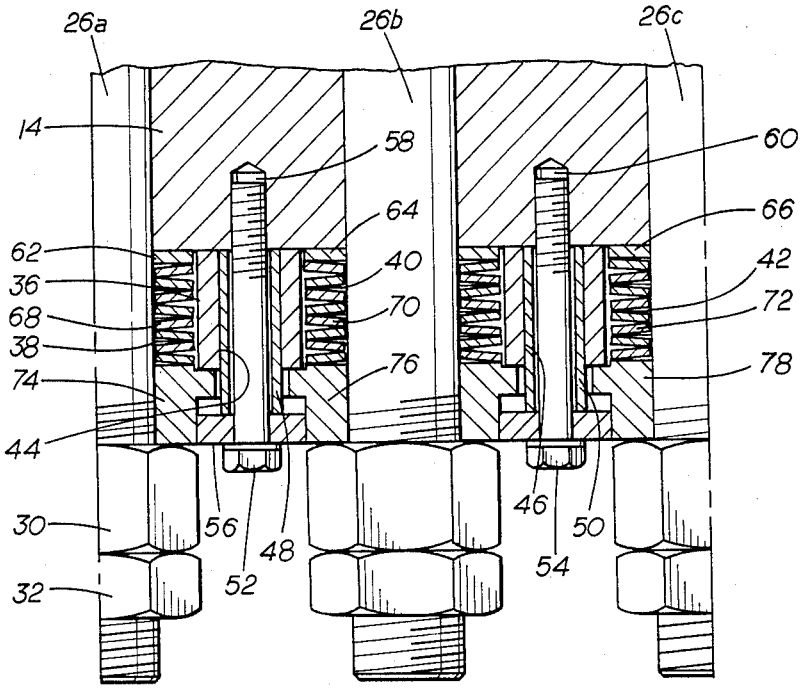
FIG. 4 is a section similar to FIG. 3 showing the subject transloader in a fully adjusted condition.

The present invention is shown in FIGS. 2–4 and forms an addition between the main frame 14 and the ends of the chain length adjustment rods 26, 28 shown in FIG. 1.

The present transloader 34 includes a spring block 36 defining at least three spring cavities 38, 40, 42 and at least two mounting passages 44, 46 extending therethrough. A cylindrical standoff member 48, 50 is positioned in each respective mounting passage 44, 46 and mounting bolts 52, 54 are passed through aligned apertures in a retaining plate 56 and standoffs 48, 50 to engage threaded bores 58, 60 and hold the entire assembly fixed with respect to the main frame 14. A hardened washer 62, 64, 66 surrounds each chain length adjustment rod **26*a*, 26*b*, 26*c* and lies against the main frame 14 supporting one end of a stack of belleville springs 68, 70, 72. A spring follower 74, 76, 78 is mounted on each respective chain length adjustment rod 26*a*, 26*b*, 26*c* and forms the restraint for the other end of the stack of belleville springs 68, 70, 72. Each chain length adjustment rod 26*a*, 26*b*, 26*c* has a conventional adjusting nut 30 and jam nut 32** threadedly mounted thereon.

The load adjusting sequence, in accordance with the present invention, is to assemble the chains 18, rods 26 and transloader 34 with the nuts backed off to close to the end of their respective rods 26. The drill string compensator is then actuated to drive it to its fully extended condition. Then the adjusting nut 30 of the middle chain length adjustment rod **26*b* is tightened until the spring follower 76 compresses the spring stack 70 to move the spring block 36 to a point where it just contacts the bottom of the main frame 14 and will not accept a 0.010" feeler gauge (not shown) between the bottom of the main frame 14 and the top of the spring block 36. The outside chain length adjustment rod nuts 30 are then tightened until the respective spring followers 74, 78 just contact the base of the spring block 36 (see FIG. 4) and will not accept a 0.010" feeler gauge therebetween. At this point, the jam nuts 32 are tightened to secure the adjustment nuts 30 in position. It will be appreciated that in this condition the chains 18** are all under the desired equal tension.

Unlike the prior art, the subject transloader 34 makes it possible to readily check the tensioning of the chains 18 at any time by simply inserting a 0.010" feeler gauge between the spring block 36 and main frame 14 or between the spring followers 74, 78 and spring block 36 as previously mentioned. Passage of the feeler gauge into the area between the spring block 36 and main frame 14 or the spring block 36 and individual followers 74, 78 would indicate the need for readjustment. Readjustment would be carried out in the same manner as the above-described initial adjustment.

While the present invention has been described with reference to a drill string compensating device, those skilled in the art will readily appreciate that the principles of the invention can be applied anywhere there are multiple chains supporting heavy loads, and it is desirable to have the weight uniformly distributed among the chains. Also, an array of three chains has been shown, but the present invention could be adapted to handle larger arrays and flexible force transmitting members other than chains, such as cables and the like. Further, the subject transloader has been shown with stacks of belleville springs, but other springs could likewise serve.

The present invention may be subject to many modifications and changes without departing from the spirit or the essential characteristics thereof. The scope of the invention should be determined by the following appended claims.

What is claimed is:

1. In an apparatus for supporting objects, said apparatus having first and second blocks and an array of a plurality of flexible force transmitting members interconnecting said blocks, transloader means to assure uniform tensioning of said flexible force transmitting members comprising:

a spring block having a number of bores equal to the number of flexible force transmitting members;

an adjustment member connected to the end of each said flexible force transmitting member and extending through a respective bore in said spring block;

spring means surrounding each said adjustment member within said bore;

spring followers on each said adjustment member engaging said spring means; and nut means on each said adjustment member whereby selective positioning of said nut means positions the respective spring follower to apply force to the spring means thereby adjusting tension of the respective flexible force transmitting member.

2. Transloader means according to claim 1 further comprising:

means to mount said spring block on one of said first or said second blocks for limited relative movement whereby a first adjustment member is adjusted to position said spring block with respect to said first or said second block and the remaining adjustment members are adjusted to position their respective spring followers with respect to said spring block.

3. Transloader means according to claim 2 wherein said means to mount said spring block comprises:

standoff means and a retaining plate secured thereto so as to limit movement of said spring block with respect to said first or said second block.

4. Transloader means according to claim 3 wherein said retaining plate further limits movement of said spring followers.

5. Transloader means according to claim 1 wherein each said spring means comprises a stack of belleville springs.

6. Transloader means according to claim 1 wherein said nut means comprises an adjusting nut and a jam nut.

7. Transloader means according to claim 1 wherein said spring followers cooperate with said spring block to comprise means for indicating variation of tension in any of said force transmitting members.

8. A transloader comprising:

a housing defining at least three parallel spaced spring cavities;

a spring array in each said spring cavity, each said spring array having retaining means on a first end and follower means on the opposite second end; and at least three adjustment rod means each extending through a respective spring array and cavity with a first end secured to a member to be tensioned and a second end carrying adjustment nuts engaging said follower means whereby positioning said housing through adjustment of a center adjustment rod means and subsequently positioning said follower means on the other adjustment rod means equalizes tension applied by said adjustment rod means.

9. A transloader according to claim 7 further comprising:

means to mount said housing for limited movement with respect to one of a pair of members joined by an array of flexible transmitting means as members to be tensioned, each said adjustment rod being connected to a respective one of said flexible force transmitting means.

10. A transloader according to claim 7 wherein each said spring array comprises a stack of belleville springs.

11. A transloader according to claim 8 wherein the position of said follower means relative to said housing indicates relative tension in said members to be tensioned.

12. In an apparatus having first and second blocks, first and second chain assemblies each connecting a respective side of said first block to said second block, one end of each said chain being fixedly attached to said first block, transloader means for adjustably tensioning the chains with respect to the second block comprising:

a spring retaining block containing a plurality of chambers equal in number to the individual chains;

a spring assembly in each said chamber;

chain adjustment means extending from the free end of each chain through the second block and a respective spring assembly and chamber in the spring retaining block;

spring follower means mounted on said chain adjustment means; and means to adjust a central chain adjustment means to position said spring block with respect to said second block and to adjust the remaining chain adjustment means to position the respective spring follower means with respect to said spring block whereby the tensioning of the respective chains can be equalized.

* * * * *